US012638281B2

(12) United States Patent
Miska et al.

(10) Patent No.: US 12,638,281 B2
(45) Date of Patent: May 26, 2026

(54) DUAL-ORIENTATION POWER AND SIGNALING SYSTEM AND METHOD THEREOF

(71) Applicant: BAE Systems Information and Electronic Systems Integration Inc., Nashua, NH (US)

(72) Inventors: Jacob W. Miska, Nashua, NH (US); Gregory S. Notaro, Bedford, NH (US); Jason H. Batchelder, Nashua, NH (US); Matthew F. Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 389 days.

(21) Appl. No.: 18/421,567

(22) Filed: Jan. 24, 2024

(65) Prior Publication Data

US 2025/0239794 A1 Jul. 24, 2025

(51) Int. Cl.
*F42B 15/36* (2006.01)

(52) U.S. Cl.
CPC ..... *F42B 15/36* (2013.01)

(58) Field of Classification Search
CPC .. F42B 15/36; F42B 15/01; F41G 7/00; F41C 15/00
See application file for complete search history.

(56) References Cited

U.S. PATENT DOCUMENTS 4,500,051 A * 2/1985 Cottle, Jr. ..... F41G 7/226 244/3.16
4,949,917 A * 8/1990 Cottle, Jr. ..... F41G 7/2213 244/3.16
6,892,646 B1 * 5/2005 Zimmerman ..... F42B 15/08 361/752
8,069,790 B1 * 12/2011 Melkers ..... F42B 15/01 102/275.9
8,291,827 B2 * 10/2012 Mellor ..... F42B 15/01 102/275.9
8,957,355 B1 * 2/2015 Truncale ..... F42B 15/01 439/55
9,366,514 B1 * 6/2016 Barnard ..... F42B 10/14
11,709,040 B2 * 7/2023 Maxwell ..... F41G 7/2226 244/3.16

(Continued)

*Primary Examiner* — Joshua E Freeman
(74) *Attorney, Agent, or Firm* — Sand, Sebolt & Wernow LPA

(57) ABSTRACT

A guided vehicle that includes a body having a first end, a second end opposite to the first end, a longitudinal axis defined between the first end and the second end, and a payload disposed inside of the body between the first end and the second end. The guided vehicle also includes a guidance kit that is configured to guide the guided vehicle, an adapter that mechanically connects the payload and the guidance kit with one another, and an electrical interconnection system that electrically connects the guidance kit and the payload with one another inside of the adapter. When the payload and the guidance kit are mechanically connected with one another and electrically connected with one another, the payload and the guidance kit are angularly aligned at a same clock position measured relative to the longitudinal axis or angularly displaced at different clock positions measured relative to the longitudinal axis.

20 Claims, 10 Drawing Sheets

(56) References Cited

U.S. PATENT DOCUMENTS

| | | | | |
|---|---|---|---|---|
| 11,733,367 | B1 * | 8/2023 | Zemany | F41G 7/2246 342/147 |
| 2010/0296258 | A1 * | 11/2010 | Geswender | H05K 1/144 361/803 |
| 2011/0026237 | A1 * | 2/2011 | Porter | H01Q 1/28 361/825 |
| 2012/0145028 | A1 * | 6/2012 | Travis | F42B 10/66 102/377 |
| 2012/0181375 | A1 * | 7/2012 | Dryer | F42B 10/661 244/3.22 |
| 2012/0181376 | A1 * | 7/2012 | Flood, Jr. | F42B 10/64 244/3.1 |
| 2012/0205487 | A1 * | 8/2012 | Mellor | F42B 15/01 244/3.21 |
| 2012/0292431 | A1 * | 11/2012 | Patel | G01S 3/781 250/226 |
| 2015/0122113 | A1 * | 5/2015 | McMahon | F42B 15/01 89/1.811 |
| 2015/0247714 | A1 * | 9/2015 | Teetzel | F42B 15/36 244/3.21 |
| 2016/0010967 | A1 * | 1/2016 | Teetzel | F42B 15/08 244/175 |
| 2019/0041178 | A1 * | 2/2019 | Choiniere | F42B 15/08 |
| 2021/0231424 | A1 * | 7/2021 | Zemany | F42B 10/14 |
| 2023/0349670 | A1 * | 11/2023 | Chrobak | F41G 7/2293 |

* cited by examiner

DUAL-ORIENTATION POWER AND SIGNALING SYSTEM AND METHOD THEREOF

TECHNICAL FIELD

The present disclosure generally relates to a system that mechanically engages and electrically connects at least one guidance kit of a projectile and a payload of the projectile with one another.

BACKGROUND ART

In military operations, modern projectiles or ballistic devices being launched from various platforms, including mobile and stationary vehicles, may be equipped with at least one guidance kit for guiding the projectile to a desired target or point of interest. Additionally, these modern projectiles are loaded with a warhead or payload that detonates and neutralizes desired targets or points of interests. With the inclusion of these guidance kits, however, payloads provided in these projectiles may share components and devices with the guidance kits to function and/or operate during a military operation. In one instance, payloads provided in these projectiles may receive power from thermal batteries or other available power sources provided in the guidance kit. In another instance, payloads provided in these projectiles may also receive communications signals from the guidance kit for denotation procedures.

With such sharing of components and devices of the guidance kits with these payloads, various electrical connections must be used to provide power and/or communication from the guidance kits to the payloads. In one instance, electrical wiring suitable for these types of guided vehicles and projectiles may be used to connect a guidance kit and a payload with one another so that power and/or communication signals may be received by the payload.

While electrical wiring and similar electrical connections are suitable, the guidance kit and the payload of a projectile may have opposing threads and/or inconsistent threads that may rotationally displace and/or angularly offset the guidance kit and payload from one another. With such issues, the electrical wiring that connects the guidance kit and the payload with one another may excessively twist and/or bend as a body of the guidance kit and the payload are threaded with one another. Such excessive twisting and bending of electrical wiring may crush and damage the internal conductors of the electrical wiring leading to transmission issues of power and communication from the guidance kit to the payload. When structural configurations of the guidance kit and the payload are inconsistent, like threading and other mechanical connections provided on these projectiles, operators and technicians may be unable to correctly assemble the projectile without having some amount of twisting and/or bending of the electrical wiring that electrically connects the guidance kit and payload with one another.

SUMMARY OF THE INVENTION

In one aspect, an exemplary embodiment of the present disclosure may provide a guided vehicle. The guided vehicle includes a body having a first end, a second end opposite to the first end, a longitudinal axis defined between the first end and the second end, and a payload disposed inside of the body between the first end and the second end. The guided vehicle also includes a guidance kit that is configured to guide the guided vehicle. The guided vehicle also includes an adapter that mechanically connects the payload and the guidance kit with one another, and an electrical interconnection system that electrically connects the guidance kit and the payload with one another inside of the adapter.

This exemplary embodiment or another exemplary embodiment may further include that when the payload and the guidance kit are mechanically connected with one another and electrically connected with one another, the payload and the guidance kit are angularly aligned at a same clock position measured relative to the longitudinal axis or angularly displaced at different clock positions measured relative to the longitudinal axis. This exemplary embodiment or another exemplary embodiment may further include that the adapter comprises: a first end; a second end longitudinally opposite to the first end; and a passageway defined between the first end and the second end and being accessible at the first end and the second end; wherein a portion of the payload and the guidance kit is housed inside of and mechanically engaged with the adapter inside of the passageway; and wherein the electrical interconnection system electrically connects with the payload and the guidance kit inside of the passageway. This exemplary embodiment or another exemplary embodiment may further include that the adapter further comprises: an interior surface extending between the first end and the second end and disposed inside of the passageway; and an internal projection extending radially into the passageway from the interior surface. This exemplary embodiment or another exemplary embodiment may further include that the electrical interconnection system comprises at least: a slip ring contact electrically connected with an electrical connection of the guidance kit; and a power and signal board electrically connected with the slip ring contact and an input port of the payload. This exemplary embodiment or another exemplary embodiment may further include that the slip ring contact comprises: a base wall having a first connection end facing the guidance kit and a second connection end opposite to the first connection end and facing the payload; and a set of first input contacts provided on the first connection end and electrically connecting with the electrical connection of the guidance kit. This exemplary embodiment or another exemplary embodiment may further include that the slip ring contact further comprises: a set of first output contacts provided on the second connection end and electrically connected with the set of first input contacts through the base wall; wherein the set of first output contacts is arranged in a concentric circle arrangement. This exemplary embodiment or another exemplary embodiment may further include that the slip ring contact further comprises: an extension extending outwardly from the base wall at the first connection end; wherein the extension is configured to operably engage with the guidance kit inside of the adapter. This exemplary embodiment or another exemplary embodiment may further include that the power and signal board comprises: a base wall having a first connection end facing the slip ring contact and a second connection end opposite to the first connection end and facing the payload; a set of second input contacts provided at the first connection end and electrically connecting with the set of first output contacts; and a second output contact provided at the second connection end and electrically connecting with the input port of the payload. This exemplary embodiment or another exemplary embodiment may further include a biaser mechanically engaged with the internal projection of the adapter, the slip ring contact, and the power and signal board; and a spacer mechanically engaged with the power and signal board and the payload;

wherein a combination of the biaser and the spacer maintains the position of the slip ring contact and the power and signal board inside of the adapter by biasing means. This exemplary embodiment or another exemplary embodiment may further include that the biaser comprises: a first engagement end mechanically engaged with the internal projection; a second engagement end opposite to the first engagement end and mechanically engaged with the power and signal board; and an opening defined in the biaser between the first engagement end and the second engagement end; wherein the slip ring contact and the power and signal board electrically connect with one another through the opening. This exemplary embodiment or another exemplary embodiment may further include that the spacer comprises: a first engagement end mechanically engaged with the power and signal board; a second engagement end opposite to the first engagement end and mechanically engaged with the payload; and an opening defined in the spacer between the first engagement end and the second engagement end; wherein the power and signal board and the payload electrically connect with one another through the opening. This exemplary embodiment or another exemplary embodiment may further include that the adapter further comprises: a first threading defined inside of the passageway proximate to the first end for threadably engaging with threads of a body of the guidance kit; and a second threading defined inside of the passageway proximate to the second end for threadably engaging with threads of the payload.

In another aspect, an exemplary embodiment of the present disclosure may provide a method. The method includes steps of: providing an adapter and an electrical interconnection system with a guided vehicle; effecting a body of a guidance kit of the guided vehicle to be mechanically connected with an adapter at a first clocking direction; effecting a payload of the guided projectile to be mechanically connected with the adapter at a second clocking direction; effecting the guidance kit and the payload to be electrically connected with one another by the electrical interconnection system; and effecting the guidance kit to output at least one signal to the payload via the electrical interconnection system; wherein the first clocking direction of the guidance kit and the second clocking direction of the payload are angularly aligned with one another or angularly misaligned with one another.

This exemplary embodiment or another exemplary embodiment may further include that the step of effecting the guidance kit and the payload to be electrically connected with one another further comprises: effecting a portion of the payload and a portion of the guidance kit to be housed inside of and mechanically engaged with the adapter; and effecting the electrical interconnection system to electrically connect the payload and the guidance kit with one another inside of the adapter. This exemplary embodiment or another exemplary embodiment may further include that the step of effecting the guidance kit and the payload to be electrically connected with one another further comprises: effecting a slip ring contact of the electrical interconnection system to electrically connect with an electrical connection of the guidance kit; and effecting a power and signal board of the electrical interconnection system to electrically connect with the slip ring contact and an input port of the payload. This exemplary embodiment or another exemplary embodiment may further include that the step of effecting the slip ring contact of the electrical interconnection system to electrically connect with the electrical connection of the guidance kit further comprises: effecting a set of first input contacts provided at a first connection end of the slip ring contact to electrically connect with the electrical connection of the guidance kit; and effecting a set of first output contacts provided at a second connection end of the slip ring contact to electrically connect with the set of first input contacts; wherein the set of first output contacts is arranged in a concentric circle arrangement. This exemplary embodiment or another exemplary embodiment may further include that the step of effecting the guidance kit and the payload to be electrically connected with one another further comprises: effecting a set of second input contacts provided on a first connection end of the power and signal board to electrically connect with the set of first output contacts of the slip ring contact; and effecting a second output contact provided on a second connection end of the power and signal board to electrically connect with an electrical power port of the payload. This exemplary embodiment or another exemplary embodiment may further include steps of effecting a biaser of the electrical interconnection system to mechanically engage with the adapter, the slip ring contact, and the power and signal board; and effecting the biaser to apply a biasing force against the slip ring contact and the power and signal board to maintain the slip ring contact and the power and signal board inside of the adapter and engaged with the guidance kit and the payload. This exemplary embodiment or another exemplary embodiment may further include steps of effecting a spacer of the electrical interconnection system to mechanically engage with the power and signal board and the payload; effecting the power and signal board and the payload to be spaced apart from one another, via the spacer, inside of the adapter.

In another aspect, an exemplary embodiment of the present disclosure may provide another method. The method includes steps of: providing a guided vehicle, wherein the guide vehicle comprises at least: a body having a first end, a second end opposite to the first end, a longitudinal axis defined between the first end and the second end, and a payload disposed inside of the body between the first end and the second end; and a guidance kit configured to guide the guided vehicle; engaging an adapter and an electrical interconnection system with the body at a first clocking direction; and engaging the adapter and the electrical interconnection system with the payload of the guided projectile at a second clocking direction; wherein the first clocking direction of the body and the second clocking direction of the payload are angularly aligned with one another or angularly misaligned with one another.

This exemplary embodiment or another exemplary embodiment may further include steps of: housing a portion of the payload and a portion of the guidance kit inside of and mechanically engaged with the adapter; and connecting the payload and the guidance kit with one another by the electrical interconnection system inside of the adapter. This exemplary embodiment or another exemplary embodiment may further include that the step of connecting the guidance kit and the payload with one another further comprises: connecting a slip ring contact of the electrical interconnection system with an electrical connection of the guidance kit; and connecting a power and signal board of the electrical interconnection system with the slip ring contact and an input port of the payload. This exemplary embodiment or another exemplary embodiment may further include that the step of connecting the slip ring contact of the electrical interconnection system with the electrical connection of the guidance kit further comprises: connecting a set of first input contacts provided at a first connection end of the slip ring contact with the electrical connection of the guidance kit; and connecting a set of first output contacts provided at a second connection end of the slip ring contact with the set of first input contacts; wherein the set of first output contacts is arranged in a concentric circle arrangement. This exemplary embodiment or another exemplary embodiment may further include that the step of connecting the guidance kit and the payload with one another further comprises: connecting a set of second input contacts provided on a first connection end of the power and signal board with the set of first output contacts of the slip ring contact; and connecting a second output contact provided on a second connection end of the power and signal board with an electrical power port of the payload. This exemplary embodiment or another exemplary embodiment may further include steps of: engaging a biaser of the electrical interconnection system with the adapter, the slip ring contact, and the power and signal board; and applying a biasing force against the slip ring contact and the power and signal board, by the biaser, to maintain the slip ring contact and the power and signal board inside of the adapter and engaged with the guidance kit and the payload. This exemplary embodiment or another exemplary embodiment may further include steps of: engaging a spacer of the electrical interconnection system with the power and signal board and the payload; and spacing the power and signal board and the payload apart from one another, via the spacer, inside of the adapter.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
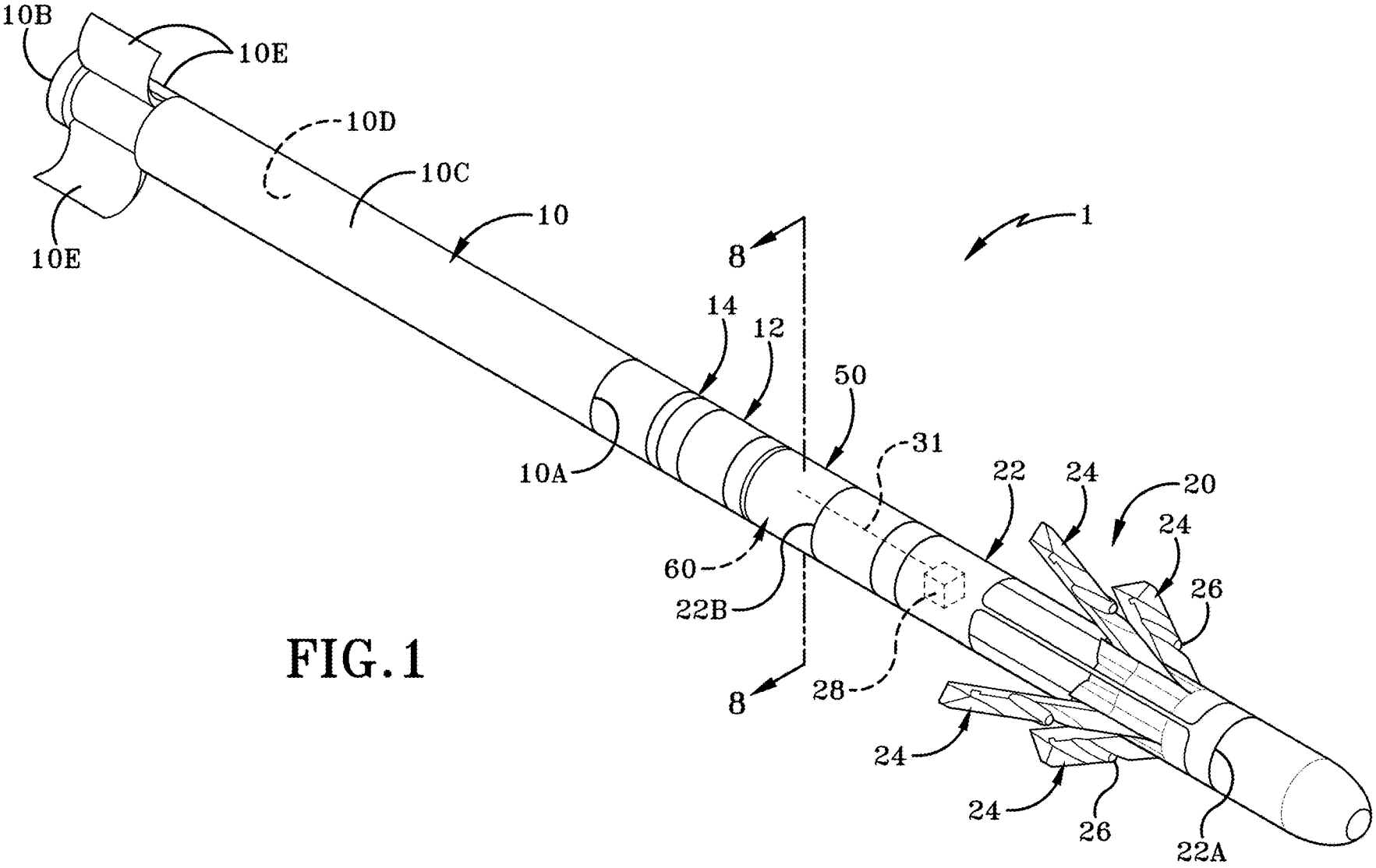
FIG. 1 (FIG. 1) is a front, top, first side isometric perspective view of a guided vehicle in accordance with one aspect of the present disclosure.

FIG. 1 illustrates a projectile, ballistic device, or guided vehicle 1 that may be equipped with a guidance kit for guiding the illustrated guided vehicle 1 to a specific target. As provided herein, the illustrated guided vehicle 1 is a Hydra 70 rocket equipped at least two guidance kits for guiding the illustrated guided vehicle 1 to a specific target, which are discussed in greater detail below. It should be understood that guided vehicle 1 may be any type of moveable device regardless of whether it is a munition. For example, the guided vehicle 1 could also be any manned or unmanned object that needs guidance in the manner discussed herein. Such use and purpose of the at least two guidance kits with the illustrated guided vehicle 1 are described in more detail below.

In the present disclosure, guided vehicle 1 is configured to be launched from a ground-based or ground-vehicle platform towards a desired airborne or ground-based target. It will be understood that the platform discussed herein is exemplary only and any type of platform is contemplated to be represented. In one exemplary embodiment, the platform described herein may be represented as an aircraft or air vehicle (e.g., fixed-wing aircraft or rotary-wing aircraft that is manned or unmanned) that is capable of launching projectiles and other similar payloads from air and striking targets in air, on land, or at sea. In another exemplary embodiment, the platform described herein may be represented as hand-held launcher, a launcher fixed to a ground transporting vehicle, a launcher fixed to a naval vehicle, or other suitable launchers for launching projectiles and other similar devices from land or sea and striking targets on land or sea. In another exemplary embodiment, the platform described herein may be a ground launch vehicle that is operably engaged with a ground surface and is configured to launch surface-to-surface projectiles or missiles (or "SSM"), ground-to-ground projectiles or missiles (or "GGM"), or surface-to-air projectiles or missiles. Stated differently, the exemplary platform is capable of launching projectiles and other similar devices from land and striking targets in the air or on land or sea.

The guided vehicle 1 may include a rocket motor or engine 10 configured to provide suitable propulsion and thrust needed for a desired military operation. The rocket motor 10 generally includes a first or front end 10A, a second or rear end 10B opposite to the first end 10A, and a longitudinal axis defined therebetween. The rocket motor 10 also generally includes a cylindrical wall 10C that extends between the first end 10A and the second end 10B along the longitudinal axis of the rocket motor 10. While not illustrated herein, suitable rocket propellants and elements may be stored inside of the cylindrical wall 10C (e.g., a chamber 10D defined inside of the cylindrical wall 10C) that generate propulsion and thrust for the rocket motor 10. The rocket motor 10 also includes an aft fin member 10E operably engaged with the cylindrical wall 10C proximate to the second end 10B of the rocket motor 10. The aft fin member 10E may provide flight assistance to the guided vehicle 1 at the second end 10B of the rocket motor 10 as the guided vehicle 1 travels through the air between the initial launch at the platform 2 and a desired target.

Figure 3:
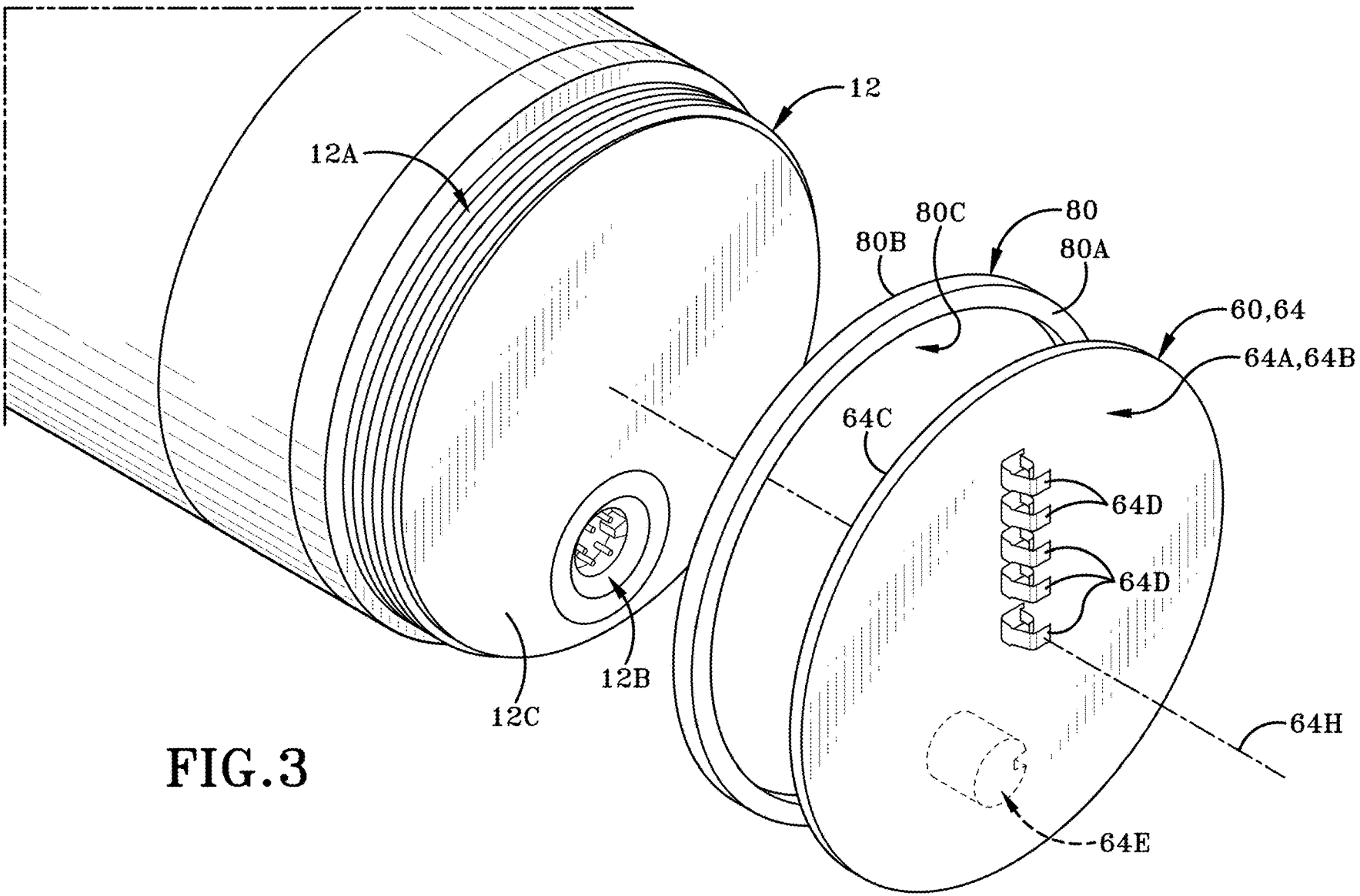
FIG. 3 (FIG. 3) is a partial exploded view of a payload of the guided vehicle, a power and signal electrical board of an electrical interconnection system, and a spacer positioned between the payload and the power and signal electrical board.

Guided vehicle 1 also includes a warhead or payload 12 with an impact-detonating fuse 14. As best seen in FIG. 1, the combination of the payload 12 and impact-detonating fuse 14 threadably engage with the first end 10A of rocket motor 10. As such, the combination of the payload 12 and impact-detonating fuse 14 are positioned ahead of and/or forward of the rocket motor 10. While the combination of the payload 12 and impact-detonating fuse 14 are positioned ahead of and/or forward of the rocket motor 10, a combination of a payload and an impact-detonating fuse may be positioned at any suitable position along a projectile described and illustrated herein. As best seen in FIG. 3, the payload 12 also includes an external threading 12A that is longitudinally opposite to the first end 10A of the rocket motor 10. Still referring to FIG. 3, the payload 12 also includes an input port 12B that is configured to transmit one or more electrical signals (including power and communication signals) to the payload 12 from an electrical interconnection system provided with the guided vehicle 1, which is discussed in greater detail below. The payload 12 also includes an engagement end 12C that directs abut and engages with a spacer (see FIG. 3); such spacer is discussed in further detail below.

In the illustrated embodiment, the rocket motor 10 of the guided vehicle 1 may be a standard 2.75-inch rocket motor (e.g., liquid-fueled rocket motors, solid-fueled rocket motors, or other suitable rocket motors of the like). In other exemplary embodiments, any suitable rocket motor may be equipped for a projectile based on the mission and/or objective.

Guided vehicle 1 also includes a guidance kit or apparatus (hereinafter "guidance kit") generally referred to as 20 that is configured to guide the guided vehicle 1 to a specific target. The guidance kit 20 may include legacy hardware and guidance programs that are configured to initiate and/or deploy on-board devices to guide and/or direct the guided vehicle 1 to a specific target. The guidance kit 20 is also configured to operably engage a rocket motor, such as rocket motor 10, to enable guidance capabilities to the rocket motor. As described above, the guidance kit 20 provided with the guided vehicle 1 is a legacy guidance kit and/or apparatus. In one example, the legacy guidance kit described and illustrated herein may be an Advanced Precision Kill Weapon System (APKWS) laser guidance kit manufactured by BAE Systems. In another example, the legacy guidance kit described and illustrated herein may be a preexisting or legacy guidance kit that includes commercially-available navigation equipment and/or instruments, including inertial navigation systems or inertial measurement units, for guiding and steering a projectile to a desired target.

Figure 2:
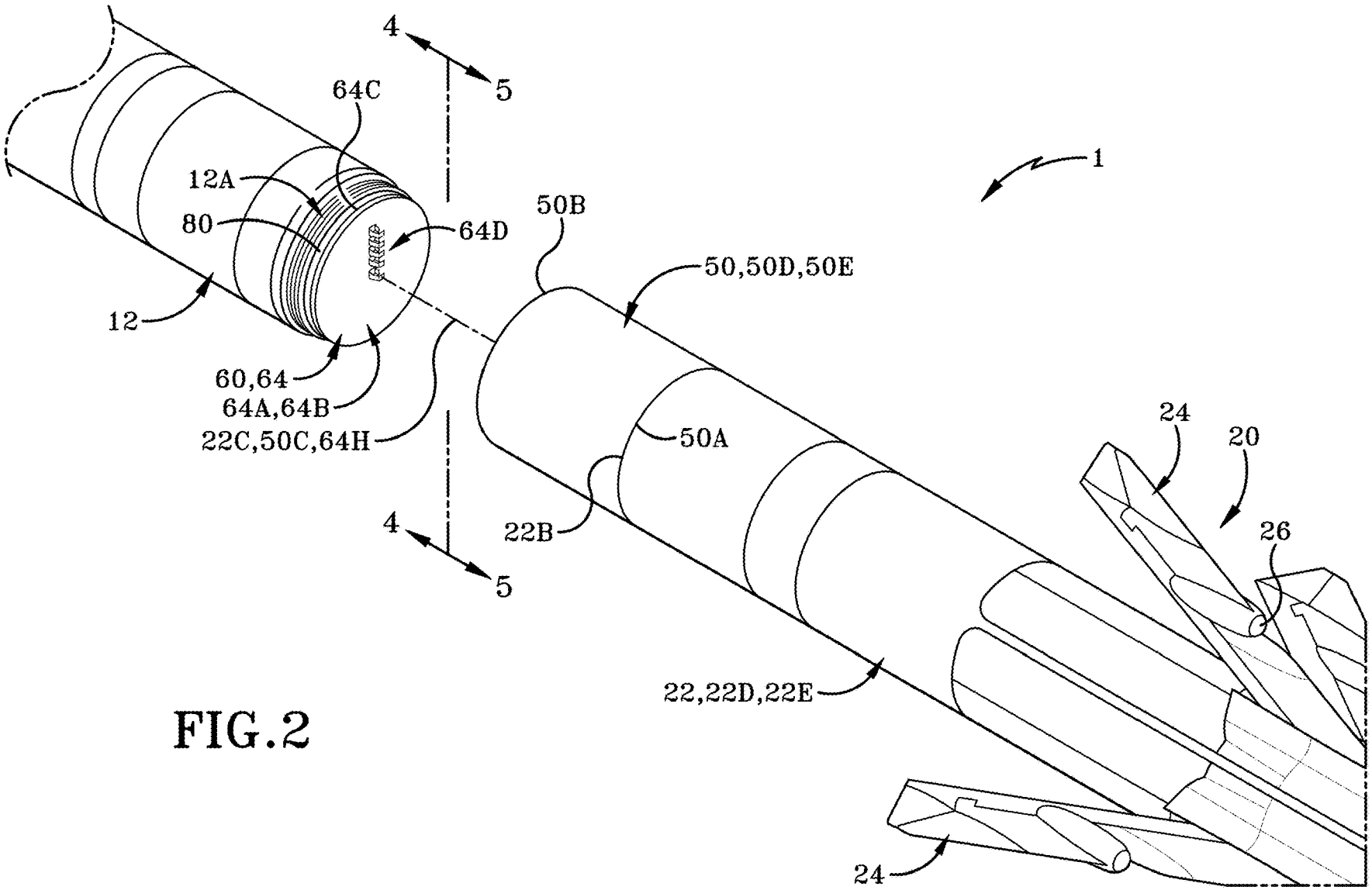
FIG. 2 (FIG. 2) is a partial exploded view of the guided vehicle shown in FIG. 1.

With respect to guidance kit 20, guidance kit 20 includes a body 22 that operably engages with the rocket motor 10 and houses the electrical components and/or device of guidance kit 20. As best seen in FIG. 2, body 22 includes a first end 22A, a second end 22B that is longitudinally opposite to the first end 22A and operably engages with rocket motor 10, and a longitudinal axis 22C defined therebetween. Body 22 also includes a wall 22D that extends along the longitudinal axis 22C between the first end 22A and the second end 22B. Still referring to FIG. 2, body 22 also includes an exterior surface 22E that extends along the wall 22D from the first end 22A to the second end 22B and faces outwardly from the wall 22D. Body 22 also includes an interior surface 22F that extends along the wall 22D from the first end 22A to the second end 22B and faces inwardly away from the exterior surface 22E (see FIG. 6).

Figure 7:
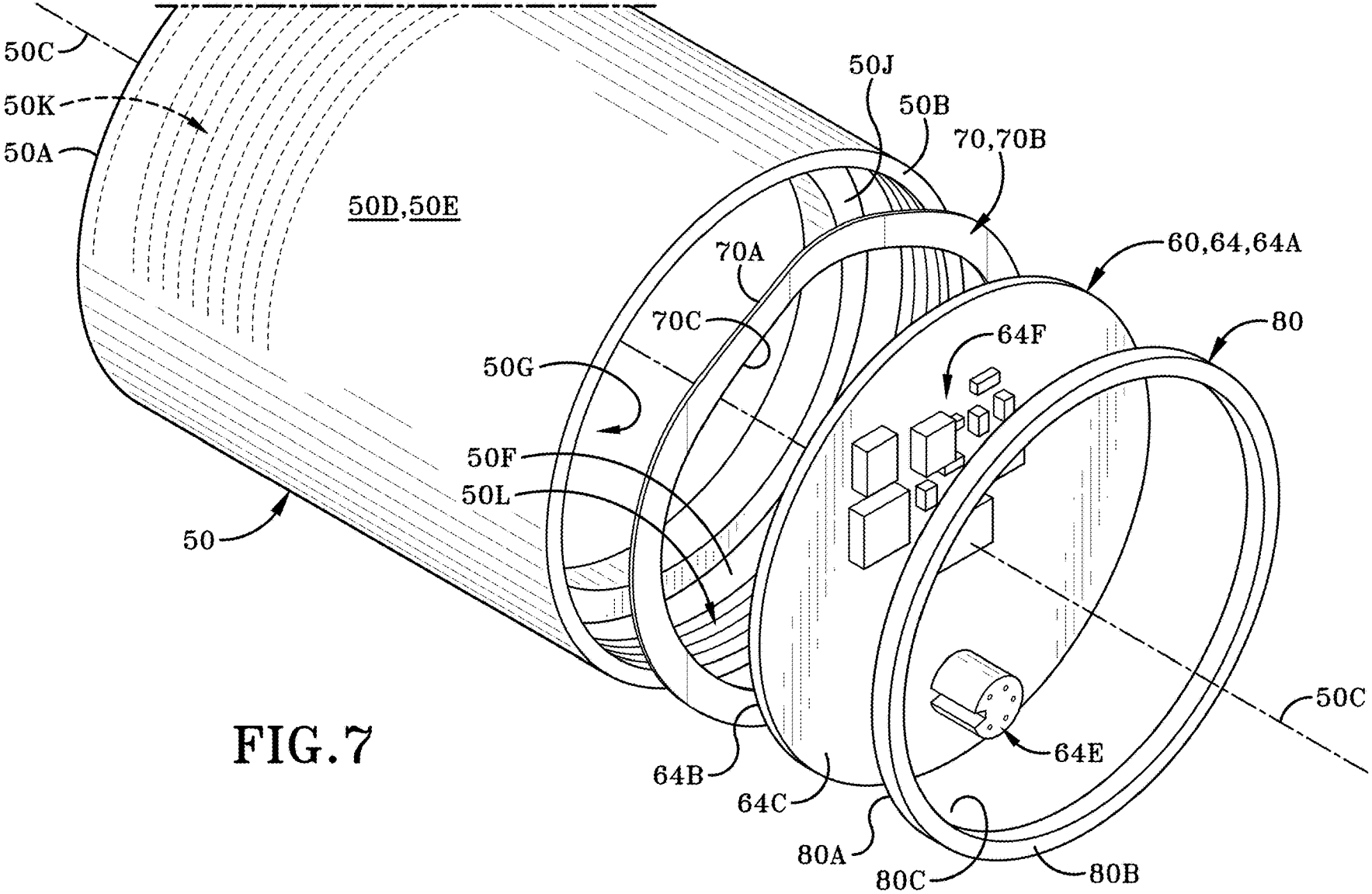
FIG. 7 (FIG. 7) is an exploded view of the adapter, the biaser, the power and signal electrical board, and the spacer.

Still referring to body 22, body 22 also defines a passageway 22G. As best seen in FIG. 7, passageway 22G is defined between the first end 22A and the second end 22B along the length of the wall 22D. In the present disclosure, passageway 22G is accessible at the first end 22A and the second end 22B since the first end 22A and the second end 22B are open ends.

Figure 6:
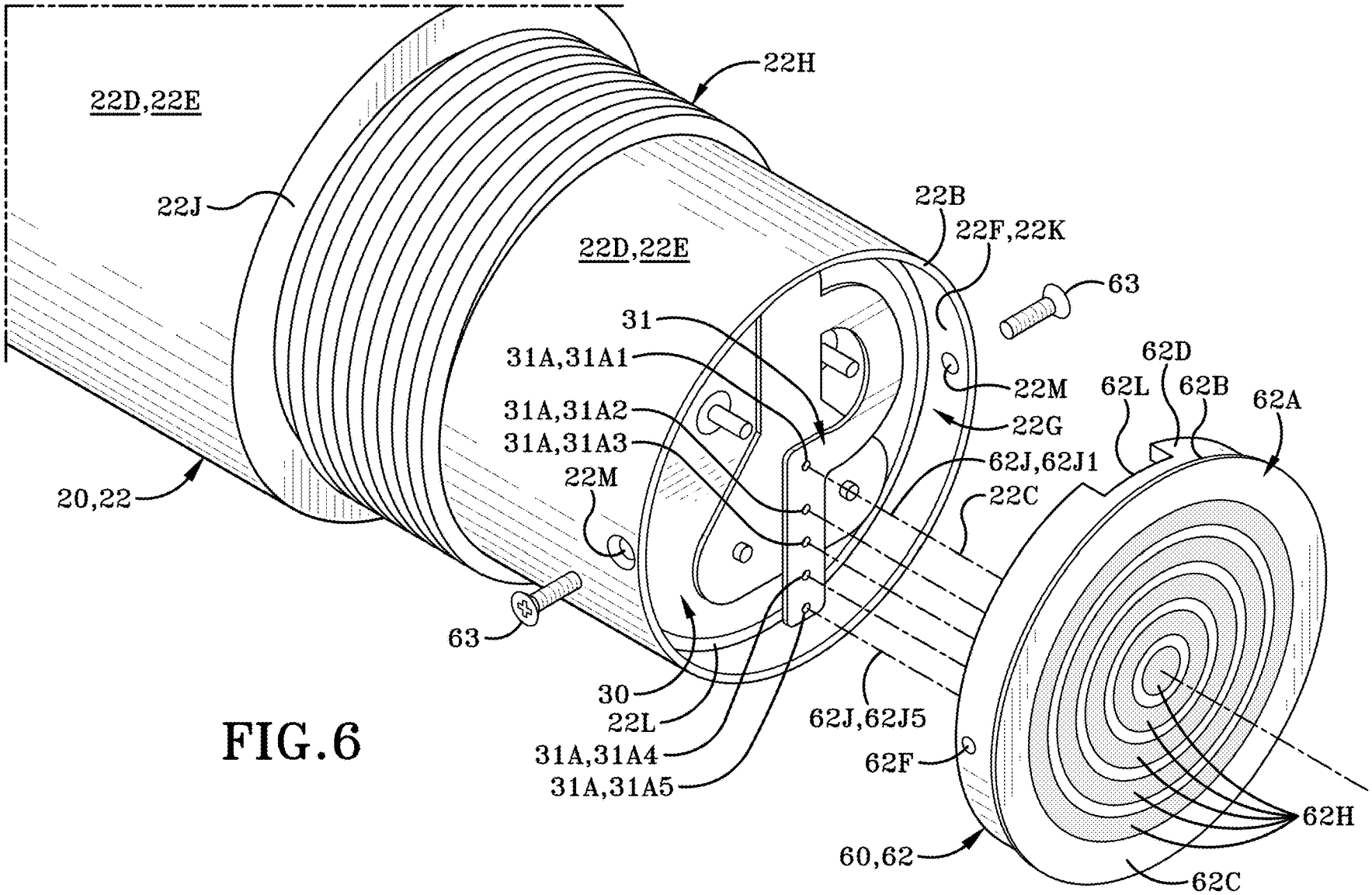
FIG. 6 (FIG. 6) is a partial exploded view of a guidance kit of the guided vehicle and the slip ring contact.

Still referring to body 22, body 22 also includes an external threading 22H. As best seen in FIG. 6, the external threading 22H is disposed along a portion of the wall 22D from an external shoulder 22J towards a location defined between the second end 22B and the external shoulder 22J. In the present disclosure, wall 22D defines a first diameter that is measured from the first end 22A to the external shoulder 22J which is greater than a second diameter that is measured from the second end 22B to the external shoulder 22J. Such configuration of the wall 22D allows for a threaded adapter of the guided vehicle 1 to threadably engage with the body 22 to house and protect electrical components of the first guidance kit and the electrical interconnection system, which is discussed in greater detail below.

Figure 8:
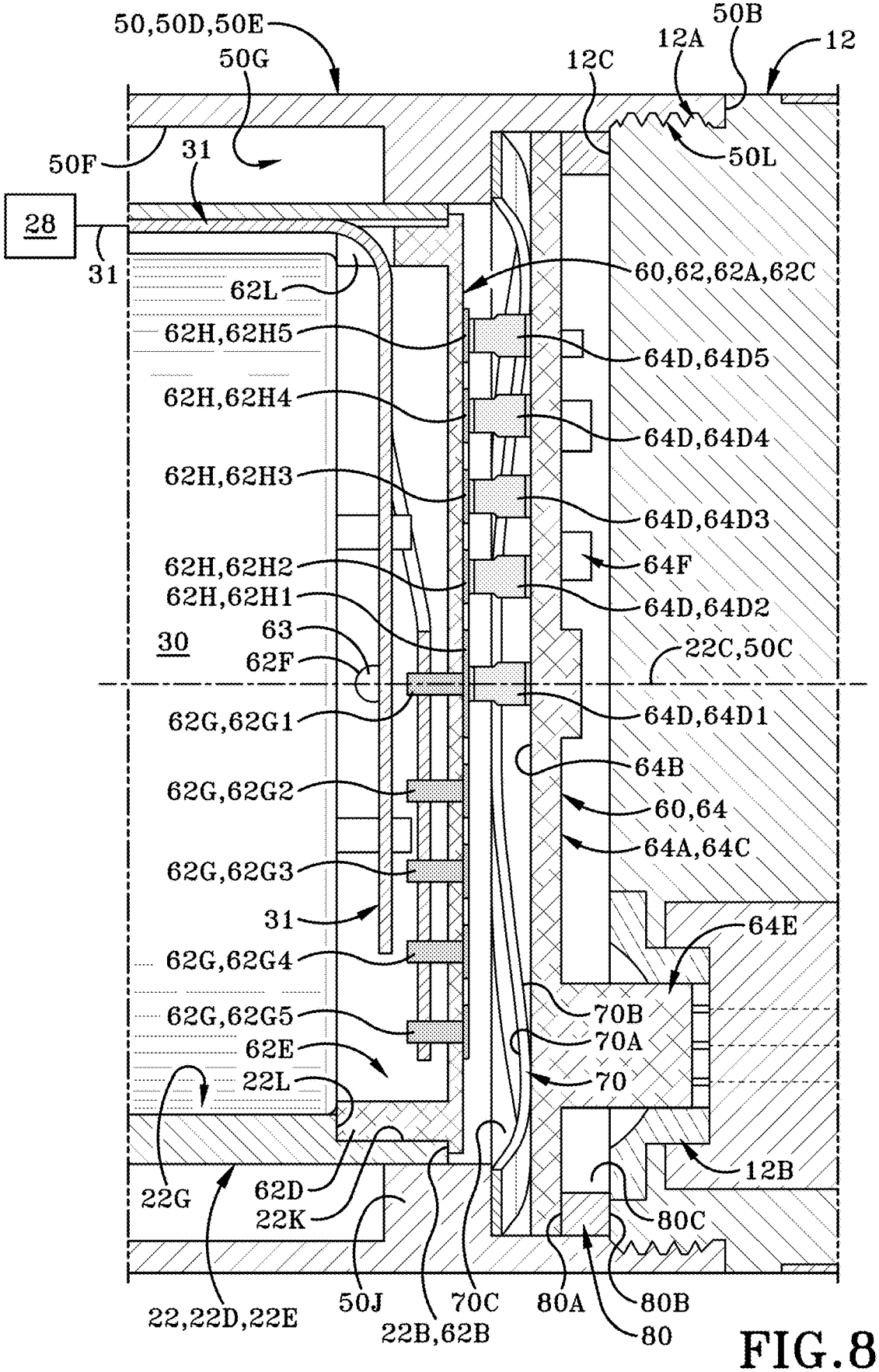
FIG. 8 (FIG. 8) is a sectional view taken in the direction of line 8-8 as shown in FIG. 1.

Still referring to body 22, body 22 also defines a depression 22K. As best seen in FIG. 8, the depression 22K extends into the interior surface 22F of body 22 and is defined between the second end 22B and an internal shoulder 22L of body 22. Such use and purpose of depression 22K and internal shoulder 22L are discussed in greater detail below. Body 22 also defines a pair of openings 22M at the second end 22B. As best seen in FIG. 6, each opening of the set of openings 22M is defined in the wall 22D and extends entirely through the wall 22D along an axis that is orthogonal to a central axis of the wall 22D. It should be noted that the passageway 22G and the external environment surrounding the body 22 are in operative communication with one another at each opening of the set of openings 22M. Such use and purpose of the set of openings 22M is discussed in greater detail below.

The guidance kit 20 may also include a set of flaperons and wings 24 that operably engages with the body 22. As best seen in FIG. 1, each wing of the set of wings 24 is moveable on the body 22 when the guided vehicle 1 is launched from a platform. More particularly, the set of wings 24 is pivotable outwardly from the body 22 and outside of the body 22 when the guided vehicle 1 is launched and travels through the air. In one exemplary embodiment, each wing of a set of wings discussed herein may be fixed and remain stationary with a body of a guidance kit such that each wing of the set of wings is free from moving relative to the body of the guidance kit.

Guidance kit 20 may also include a set of optical imaging devices or seekers 26. As best seen in FIG. 2, each optical imaging device of the set of optical imaging device 26 operably engages with a corresponding wing of the set of wings 24. In the present disclosure, a portion of each optical imaging device of the set of optical imaging devices 26 is visible to the external environment and/or far field forward of the guided vehicle 1. During operation, each optical imaging device of the set of optical imaging devices 26 is configured to visualize and detect one or more electromagnetic wavelengths (e.g., visible light or visible spectrum wavelengths, infrared wavelengths, ultraviolet wavelengths, etc.) of desired targets, particularly aircrafts and air vehicles in flight. In one instance, each optical imaging device of the set of optical imaging devices 26 may be a laser-based guidance device and/or sensor that is led by a laser device to a desired target or point-of-interest.

Guidance kit 20 also includes a controller 28. As best seen in FIGS. 1 and 8, controller 28 is shown diagrammatically herein and is housed inside of the body 22. In the present disclosure, controller 28 is configured to control and command guidance protocols and/or programs that are accessible and executable by controller 28 on a computer readable medium to guide the guided vehicle 1 to a desired location. It should be understood that controller 28 may be any conventional and/or commercially available controller that is configured to control and command guidance protocols and/or programs that are accessible and executable by the controller on a computer readable medium to guide the guided vehicle 1 to a desired location.

Guidance kit 20 also includes a power source 30. As best seen in FIGS. 6 and 8, power source 30 operably engages with the interior surface 22F of wall 22D inside of the passageway 22G. In the present disclosure, the power source 30 is electrically connected with the controller 28 by at least one electrical connection 31. The power source 30 may be configured to power the payload 12, the controller 28, and other components or devices that are provided in the guidance kit 20 or in the guided vehicle 1. It should be understood that while the at least one electrical connection 31 is used to deliver power from the power source 30 to the controller 28, the at least one electrical connection 31 may also deliver communication signal from the controller 28 to the input port 12B of the payload 12 via an electrical interconnection system of the guided vehicle 1, which is discussed in greater detail below.

Guided vehicle 1 also includes an adapter 50 that operably engages with the payload 12 and the body 22 of the guidance kit 20 and houses electrical components and/or devices of an electrical interconnection system, which is discussed in greater detail below. In the present disclosure, adapter 50 includes a first end 50A that operably engages with the body 22 (see FIG. 2), a second end 50B that is longitudinally opposite to the first end 50A and operably engages with payload 12 (see FIG. 8), and a longitudinal axis 50C defined therebetween. Adapter 50 also includes a wall 50D that extends along the longitudinal axis 50C between the first end 50A and the second end 50B. Referring to FIG. 7, adapter 50 also includes an exterior surface 50E that extends along the wall 50D from the first end 50A to the second end 50B and faces outwardly from the wall 50D. Adapter 50 also includes an interior surface 50F that extends along the wall 50D from the first end 50A to the second end 50B and faces inwardly away from the exterior surface 50E.

Still referring to adapter 50, adapter 50 also defines a passageway 50G. As best seen in FIG. 7, passageway 50G is defined between the first end 50A and the second end 50B along the length of the wall 50D. In the present disclosure, passageway 50G is accessible at the first end 50A and the second end 50B since the first end 50A and the second end 50B are open ends.

Still referring to adapter 50, adapter 50 also includes an internal projection 50J. As best seen in FIGS. 7-8, the internal projection 50J also extends radially into the passageway 50G from the interior surface 50F and is positioned near the second end 50B. Such use and purpose the internal projection 50J is discussed in greater detail below.

Still referring to adapter 50, adapter 50 also includes a first internal threading 50K and a second internal threading 50L. As best seen in FIG. 7, the first internal threading 50K is defined along a portion of the interior surface 50F inside of the passageway 50G. Upon assembly of the guided vehicle 1, the first internal threading 50K is complementary with and/or matches the external threading 22H of the body 22 so that the body 22 and the adapter 50 threadably engage with one another. As best seen in FIGS. 7 and 8, the second internal threading 50L is defined along a portion of the wall 22D that is measured from the second end 50B to a location defined between the second end 50B and the internal projection 50J inside of the passageway 50G. Upon assembly of the guided vehicle 1, the second internal threading 50L is complementary with and/or matches the external threading 12A of the payload 12 so that the payload 12 and the adapter 50 threadably engage with one another.

Guided vehicle 1 also includes an electrical interconnection system (hereinafter "system") 60. In the present disclosure, system 60 is configured to send communication signals from the controller 28 of the guidance kit 20 to the input port 12B of the payload 12 and/or power from the power source 30 of the guidance kit 20 to the input port 12B of the payload 12 during flight of the guided vehicle 1. The system 60 is also configured to send both power and communication signals from the guidance kit 20 to the payload 12 where the guidance kit 20 and the payload 12 are orientated at different angular orientation or clocking orientation relative to one another. Such components of the system 60 is now discussed in greater detail below.

Figure 6A:
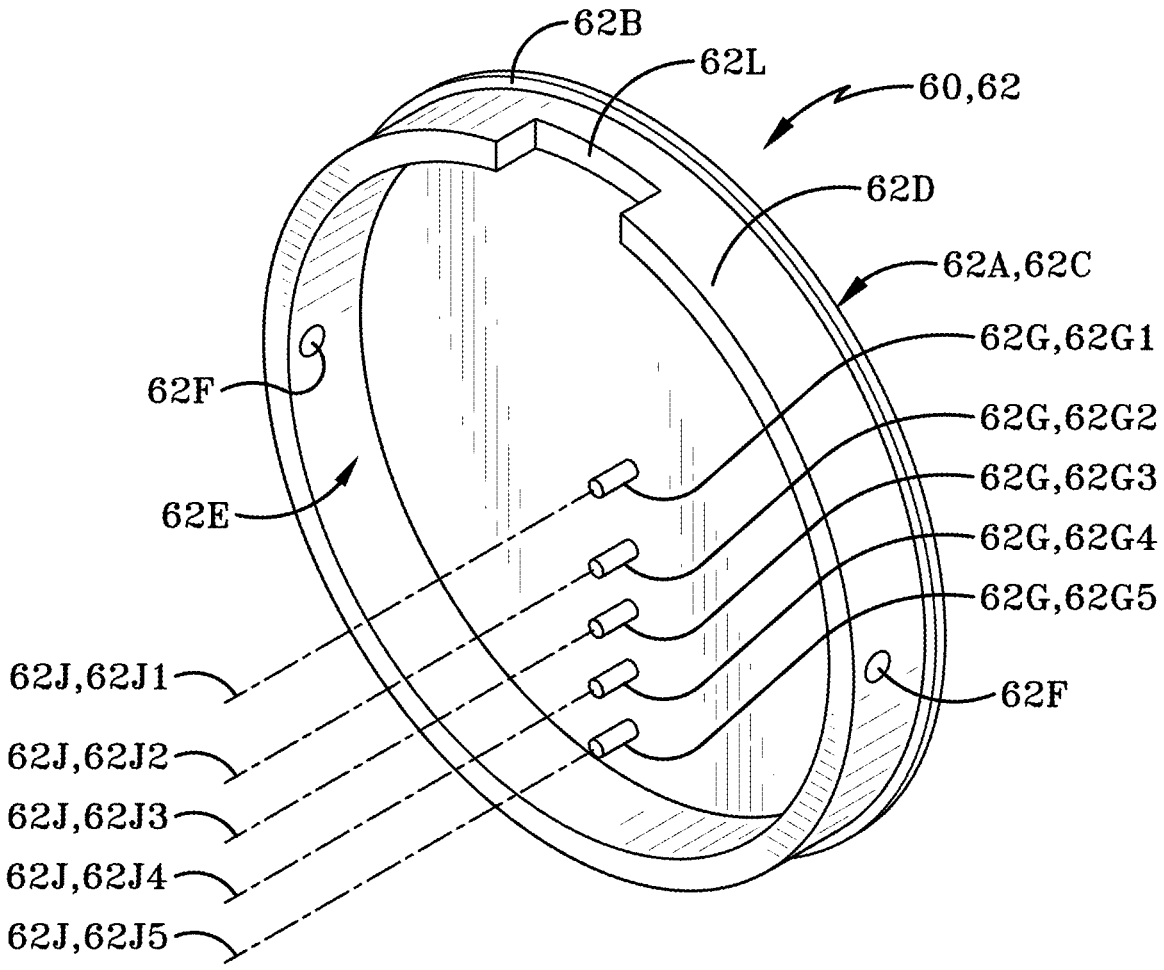
FIG. 6A (FIG. 6A) is a front, top, second side isometric perspective view of the slip ring contact.

System 60 includes a slip ring contact 62. As best seen in FIG. 6A, slip ring contact 62 includes a base wall 62A that has a first or input connection end 62B and a second or output connection end 62C that faces in an opposite direction relative to the first connection end 62B. Slip ring contact 62 also includes an extension 62D that extends outwardly from the first connection end 62B of the base wall 62A. In the present disclosure, the base wall 62A and the extension 62D form a single, monolithic device. In one exemplary embodiment, the base wall 62A and the extension 62D may be separate components and connected with one another by any suitable attachment or connections means considered suitable in this art. Slip ring contact 62 also includes a recess 62E that is collectively defined by the first connection end 62B of the base wall 62A and the extension 62D; such use and purpose of the recess 62E is discussed in greater detail below.

Slip ring contact 62 also defines a set of attachment apertures 62F. As best seen in FIG. 6A, each aperture of the set of attachment apertures 62F is defined in the extension 62D and extends entirely through the extension 62D along an axis that is orthogonal to a central axis of the extension 62D. It should be noted that the recess 62E and the external environment surrounding the slip ring contact 62 are in operative communication with one another at each aperture of the set of attachment apertures 62F. Such use and purpose of the set of attachment apertures 62F is discussed in greater detail below.

Slip ring contact 62 also includes a set of first input contacts 62G. As best seen in FIG. 6A, each input contact of the set of first input contacts 62G is provided on the first connection end 62B of the base wall 62A and is disposed inside of the recess 62E. In the present disclosure, the set of first input contacts 62G includes five input contacts that are disposed inside of the recess 62E. Referring to FIG. 6A, a first input contact 62G1 of the set of first input contacts 62G operably engages with the electrical connection 31 inside of a first opening 31A1 of a set of opening 31A. The remaining second, third, fourth, and fifth input contacts 62G2, 62G3, 62G4, 62G5 of the set of first input contacts 62G operably engage with the electrical connection inside of second, third, fourth, and fifth openings 31A2, 31A3, 31A4, 31A5 of the set of openings 31A. Upon such engagement, the controller 28 and the battery 30 are electrically connected with the slip ring contact 62 by the electrical connection 31.

Figure 5:
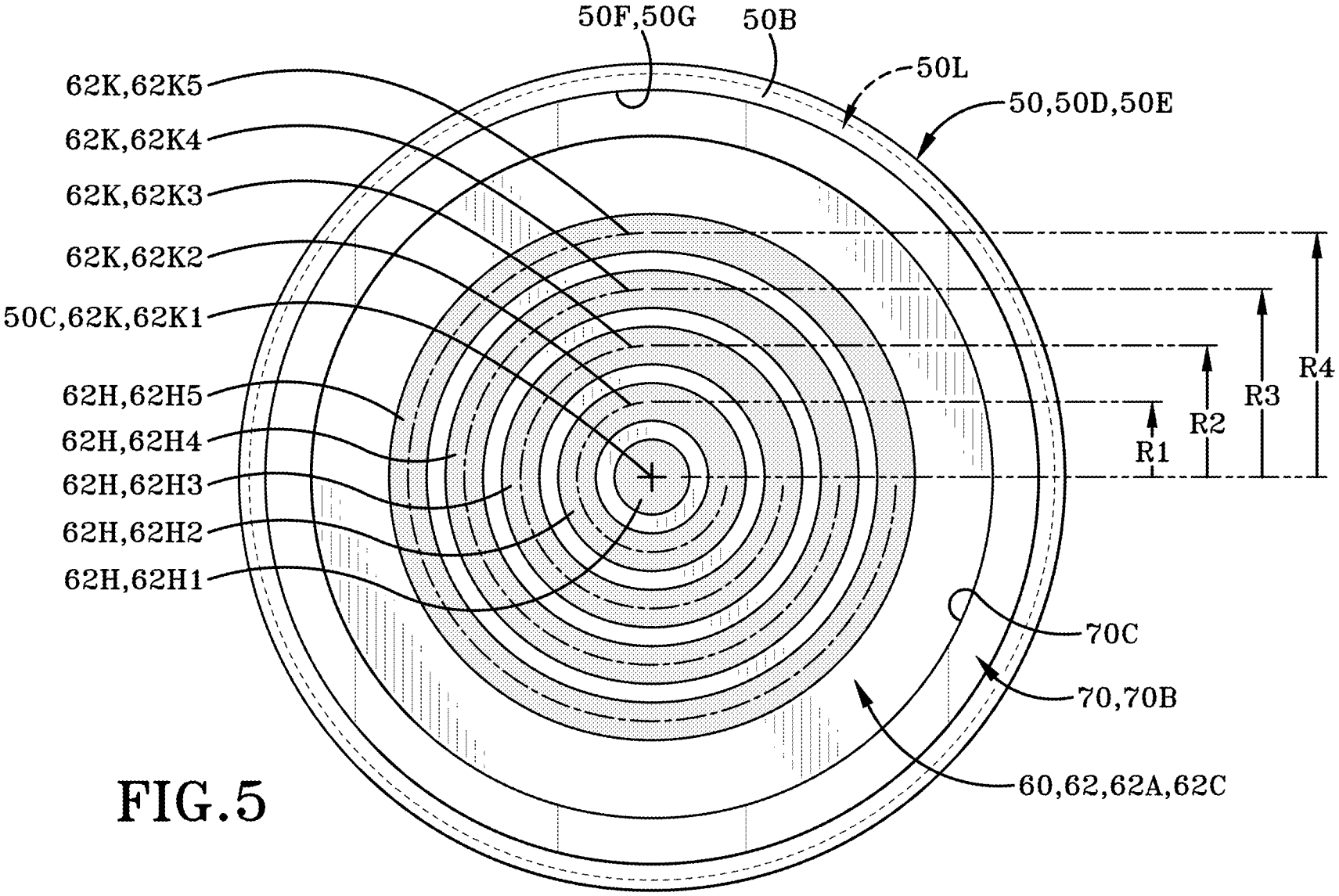
FIG. 5 (FIG. 5) is a rear elevation view of an adapter, a slip ring contact of the electrical interconnection system, and a biaser taken in the direction of line 5-5 as shown in FIG. 2.

Slip ring contact 62 also includes a set of first output contacts 62H. Referring to FIG. 5, each output contact of the set of first output contacts 62H is provided on the second connection end 62C of the base wall 62A and is disposed outside of the recess 62E. In the present disclosure, the set of first output contacts 62H includes five input contacts that are disposed on the second connection end 62C and connect with the set of first input contacts 62G. Referring to FIG. 6A, a first output contact 62H1 of the set of first output contacts 62H connects with the first input contact 62G1 of the set of first input contacts 62G. The remaining second, third, fourth, and fifth output contacts 62H2, 62H3, 62H4, 62H5 of the set of first output contacts 62H connect with the second, third, fourth, and fifth input contacts 62G2, 62G3, 62G4, 62G5 of the set of first input contacts 62G.

In the present disclosure, such connection between each input contact of the set of first input contacts 62G and a corresponding output contact of the set of first output contacts 62H transmits power one or more communication signals from the guidance kit 20 to the payload 12 during operation. In the present disclosure, each input contact of the set of first input contacts 62G electrically connects with the electrical connection 31 of the guidance kit 20 so that the slip ring contact 62 transmits power and communication signals to the payload 12. In the present disclosure, each output contact of the set of first output contacts 62H is also arranged in a concentric circle arrangement (when viewed from a rear elevation view (see FIG. 5) so that a power and signal board of the system 60 electrically connects with the slip ring contact 62 at any angular orientation or clocking orientation; such power and signal board of the system 60 and electrical connections of the system 60 are discussed in greater detail below.

With respect to the set of first output contacts 62H, each output contact of the set of first output contacts 62H defines a different radius that is measured relative to each central axis of a set of circumferential axes 62K to construct the concentric circle arrangement. As best seen in FIG. 5, a first radius R1 is measured from a first circumferential axis 62K1 of the first output contact 62H1 to a second circumferential axis 62K2 of the second output contact 62H2. Similarly, a second radius R2 is measured from the first circumferential axis 62K1 of the first output contact 62H1 to a third circumferential axis 62K3 of the third output contact 62H3, a third radius R3 is measured from the first circumferential axis 62K1 of the first output contact 62H1 to a fourth circumferential axis 62K4 of the fourth output contact 62H4, and a fourth radius R4 is measured from the first circumferential axis 62K1 of the first output contact 62H1 to a fifth circumferential axis 62K5 of the fifth output contact 62H5. In the present disclosure, the fourth radius R4 is greater than the first, second, and third radii R1, R2, R3, the third radius R3 is greater than the first and second radii R1, R2, and second radius R2 is greater than the first radius R1.

Still referring to slip ring contact 62, slip ring contact 62 also defines a notch 62L. As best seen in FIG. 6A, the notch 62L is defined in the extension 62D above the set of first input contacts 62G and the set of first output contacts 62H. It should be understood that the recess 62E and the external environment surrounding the slip ring contact 62 are in operative communication with one another at the notch 62L. In the present disclosure, the notch 62L is configured to receive and house a portion of the electrical connection 31 when the slip ring contact 62 engages with the body 22, which is discussed in greater detail below.

System 60 also includes a pair of fasteners 63. As best seen in FIG. 6, the pair of fasteners 63 operably engage the body 22 of the guidance kit 20 and the slip ring contact 62 with one another inside of the set of openings 22M and the set of attachment apertures 62F. Once the guided vehicle 1 is assembled, the pair of fasteners 63 is housed inside of the adapter 50.

System 60 also includes a power and signal board (hereinafter "electrical board") 64. As best seen in FIG. 3, the electrical board 64 includes a base wall 64A that has a first or input connection end 64B and a second or output connection end 64C that faces in an opposite direction relative to the first connection end 64B. The electrical board 64 also includes a set of second input contacts 64D and a second output contact 64E. As best seen in FIG. 3, each input contact of the set of second input contacts 64D is provided on the first connection end 64B of the base wall 64A and faces the slip ring contact 62. Still referring to FIG. 3, the second output contact 64E is provided on the second connection end 64C of the base wall 64A and faces the payload 12. In the present disclosure, the set of second input contacts 64D electrically connect with the set of first output contacts 62H of the slip ring contact 62, and the second output contact 64E electrically connects with the input port 12B of the payload 12 (see FIG. 8).

Electrical board 64 also includes a set of processing devices 64F. As best seen in FIG. 7, the set of processing devices 64F is disposed on the second connection end 64C and is configured to electrically connect with the set of second input contacts 64D and the second output contact 64E. In the present disclosure, the set of processing devices 64F is configured to regulate power that was transmitted from guidance kit 20 prior to such power being outputted to the payload 12. In the present disclosure, the set of processing devices 64F is also configured to format communication signals that were transmitted from guidance kit 20 prior to such communication signals being outputted to the payload 12.

Figure 4:
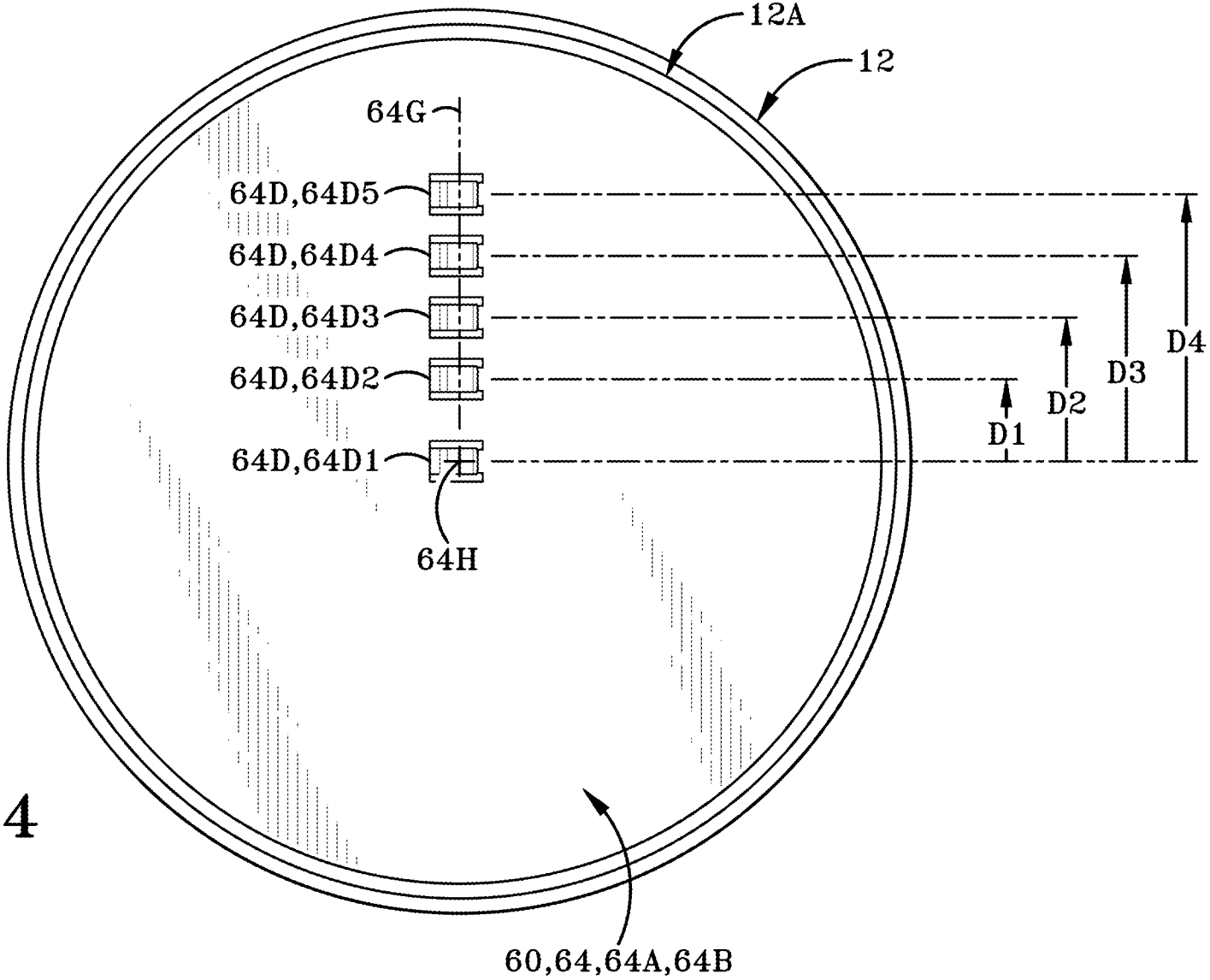
FIG. 4 (FIG. 4) is a front elevation view of the power and signal electrical board, the spacer, and the payload taken in the direction of line 4-4 as shown in FIG. 2.

As best seen in FIG. 4, the set of second input contacts 64D includes five input contacts that are disposed on the first connection end 64B (see FIG. 4). In the present disclosure, a first input contact 64D1 of the set of second input contacts 64D is configured to operably engage with the first output contact 62H1 of the set of first output contacts 62H. The remaining second, third, fourth, and fifth input contacts 64D2, 64D3, 64D4, 64D5 of the set of second input contacts 64D operably engage with the second, third, fourth, and fifth output contacts 62H2, 62H3, 62H4, 62H5 of the set of first output contacts 62H of the slip ring contact 62. Upon such engagement, the slip ring contact 62 transmits power and/or one or more communication signals to the electrical board 64.

With respect to the set of second input contacts 64D, each input contact of the set of second input contacts 64D is also spaced apart at different distances along a primary axis 64G to electrically connect with the set of first output contacts 62H. As best seen in FIG. 4, a first distance D1 is measured from the first input contact 64D1 to the second input contact 64D2 where the first input contact 64D1 lies on a central axis 64H that extends between the first connection end 64B and the second connection end 64C. Similarly, a second distance D2 is measured from the first input contact 64D1 to the third input contact 64D3, a third distance D3 is measured from the first input contact 64D1 to the fourth input contact 64D4, and a fourth distance D4 is measured from the first input contact 64D1 to the fifth input contact 64D5. In the present disclosure, the fourth distance D4 is greater than the first, second, and third distances D1, D2, D3, the third distance D3 is greater than the first and second distances D1, D2, and second distance D2 is greater than the first distance D1.

As discussed above, each input contact of the set of second input contacts 64D electrically connects with a corresponding output contact of the set of first output contacts 62H of the slip ring contact 62. In the present disclosure, each input contact of the set of second input contacts 64D may electrically connect with a corresponding output contact of the set of first output contacts 62H of the slip ring contact 62 at any angular orientation or clocking orientation when the guided vehicle 1 when the guided vehicle 1 is assembled. Stated differently, the set of second input contacts 64D of the electrical board 64 may contact the set of first output contacts 62H of the slip ring contact 62 at any position along the circumference of the corresponding output contact of the set of first output contacts 62H. As such, the payload 12 and the guidance kit 20 may be arranged at different clocking orientations relative to the one another while the slip ring contact 62 and the electrical board 64 still electrically connect with one another at any angular orientation or clocking orientation.

The structural configuration between the slip ring contact 62 and the electrical board 64 is considered advantageous at least because the system 60 eliminates the need of electrical wiring between the payload 12 and the guidance kit 20 in order for the controller 28 and/or the power source 30 to output power and/or one or more communications signals to the payload 12. In this embodiment, the electrical board 64 electrically connects with the slip ring contact 62 without using electrical wiring that may be twisted and/or damaged during the assembly of the guided vehicle 1. Instead, the set of second input contacts 64D of the electrical board 64 may electrically connect with the set of first output contacts 62H of the slip ring contact 62 at any angular orientation or clocking orientation on the slip ring contact 62.

Guided vehicle 1 may also include a biaser or wave spring 70. As best seen in FIG. 7, the biaser 70 includes a first engagement end 70A, a second engagement end 70B that faces opposite to the first engagement end 70A, and an opening 70C that extends entirely through the biaser 70 between the first engagement end 70A and the second engagement end 70B. It should be noted that the first engagement end 70A and the second engagement end 70B are in operative communication with one another at the opening 70C. Such use and purpose of biaser 70 is discussed in greater detail below.

Guided vehicle 1 may also include a spacer 80. As best seen in FIG. 7, the spacer 80 includes a first engagement end 80A, a second engagement end 80B that faces opposite to the first engagement end 80A, and an opening 80C that extends entirely through the spacer 80 between the first engagement end 80A and the second engagement end 80B. It should be noted that the first engagement end 80A and the second engagement end 80B are in operative communication with one another at the opening 80C. Such use and purpose of spacer 80 is discussed in greater detail below.

Having now described the components of the guided vehicle 1, a method of assembling the payload 12 and the guidance kit 20 with adapter 50, the system 60, the biaser 70, and spacer 80 is now discussed in greater detail below.

Initially, an operator or technician may connect the electrical connection 31 of the guidance kit 20 with the system 60. As best seen in FIG. 8, the electrical connection 31 is connected with the set of first input contacts 62G of the slip ring contact 62 inside of the recess 62E. In one exemplary embodiment, the electrical connection 31 is welded or bonded with the set of first input contacts 62G of the slip ring contact 62 inside of the recess 62E. In other exemplary embodiments, any suitable materials or devices may be used to connect the electrical connection 31 of the guidance kit 20 and the set of first input contacts 62G of the slip ring contact 62 with one another. Upon such connection, the extension 62D of the slip ring contact 62 operably engages with the internal shoulder 22L of the body 22 and is substantially housed inside of the depression 22K.

The operator may then introduce and engage the adapter 50 to the body 22 of the guidance kit 20. In the present disclosure, the first internal threading 50K of the adapter 50 threadably engages with the external threading 22H of the body 22. Once engaged, a portion of the body 22 that is measured from the second end 22B to the external shoulder 22J is housed inside of the passageway 50G of adapter 50.

Upon such engagement between the body 22 and the adapter 50, the operator may then introduce and engage the biaser 70 with the adapter 50 and the slip ring contact 62. As best seen in FIG. 8, the first engagement end 70A of the biaser 70 contacts and engages with the internal projection 50J of the adapter 50 inside of the passageway 50G.

The operator may then introduce and engage the electrical board 64 with the slip ring contact 62 and the biaser 70. As best seen in FIG. 8, the set of second input contacts 64D of the electrical board 64 electrically connects with the set of first output contacts 62H of the slip ring contact 62. It should be noted that each input contact of the set of second input contacts 64D may electrically contact with a corresponding output contact of the set of first output contacts 62H at any position along the circumference of the corresponding output contact regardless of the angular orientation or clocking orientation between the slip ring contact 62 and the electrical board 64.

Concurrently, the base wall 64A of the electrical board 64 also contacts and engages with the biaser 70. As best seen in FIG. 8, the first connection end 64B of the electrical board 64 contacts and engages with the second engagement end 70B of the biaser 70. Once engaged, the electrical connections between the set of first output contacts 62H of the slip ring contact 62 and the set of second input contacts 64D of the electrical board 64 are free from being interfering with by the biaser 70 due to the set of first output contacts 62H of the slip ring contact 62 and the set of second input contacts 64D of the electrical board 64 passing through the opening 70C of the biaser 70.

The operator may then introduce and engage the spacer 80 with the electrical board 64. As best seen in FIG. 8, the second connection end 64C of the electrical board 64 contacts and engages with the first engagement end 80A of the spacer 80. Once engaged, the set of processing devices 64F is free from interfering with the spacer 80 due to the set of processing devices 64F being housed inside of the opening 80C of the spacer 80. The spacer 80 also spaces the payload 12 and the electrical board 64 at a suitable distance so that the set of processing devices 64F is not engaged with or contacting the payload 12. As best seen in FIG. 8, the first engagement end 80A of the spacer 80 operably engages with the second connection end 64C of the electrical board 64, and the second engagement end 80B of the spacer 80 operably engages with the engagement end 12C of payload 12.

Lastly, the operator may then introduce and engage payload 12 (including the rocket motor 10 and the remaining devices engaged with the payload 12) with the adapter 50 and the electrical board 64. As best seen in FIG. 8, the second internal threading 50L of the adapter 50 threadably engages with the external threading 12A of the payload 12. Once engaged, a portion of the payload 12 is housed inside of the passageway 50G of adapter 50. Concurrently, the second output contact 64E of the electrical board 64 also electrically connects with the input port 12B of the payload 12.

Once assembled, the biaser 70 also applies a continuous biasing force on the adapter 50 and the electrical board 64 once the biaser 70 is compressed by the adapter 50 and the electrical board 64 inside of the passageway 50G. Such compression by the biaser 70 provides a mechanical engagement between the payload 12, the adapter 50, the slip ring contact 62, the electrical board 64, and the spacer 80 to prevent the slip ring contact 62 and the electrical board 64 from longitudinally moving or shifting inside of the adapter 50.

Having now described the method of assembling the payload 12 and the guidance kit 20 with the adapter 50, the system 60, the biaser 70, and the spacer 80, a method of transmitting one or more signals from the guidance kit 20 to the payload 12 is discussed in greater detail below.

In operation, one or both of the controller 28 and the power source 30 of the guidance kit 20 may output power or one or more communication signals over the electrical connection 31 to the slip ring contact 62. Once at least one signal is outputted, at least one signal is transmitted from one or both of the controller 28 and the power source 30 to the set of first input contacts 62G via the electrical connection 31. Upon receiving the at least one signal, the set of first input contacts 62G of the slip ring contact 62 then transmits the at least one signal through the slip ring contact 62 and to the set of first output contacts 62H.

Once the at least one signal is received by the set of first output contacts 62H, the slip ring contact 62 then transmits the at least one signal to the electrical board 64 for regulating power and/or formatting the communicating signal. In the present disclosure, the set of first output contacts 62H transmits the at least one signal to the set of second input contacts 64D of the electrical board 64. Once the at least one signal is received by the set of second input contacts 64D, the at least one signal is then transmitted to the set of processing devices 64F prior to the at least one signal being transmitted to the payload 12. In one instance, the set of processing devices 64F may regulate the power provided in the at least one signal if the at least one signal was outputted by the power source 30. In another instance, the set of processing devices 64F may format the communication data provided in the at least one signal if the at least one signal was outputted by the controller 28.

Once the at least one signal has been regulated and/or formatted by the set of processing devices 64F, the at least one signal is then outputted from the set of processing devices 64F to the payload 12 via the second output contact 64E of the electrical board 64. In the present disclosure, the at least one signal is transmitted from the second output contact 64E to the input port 12B of the payload 12.

Figure 9:
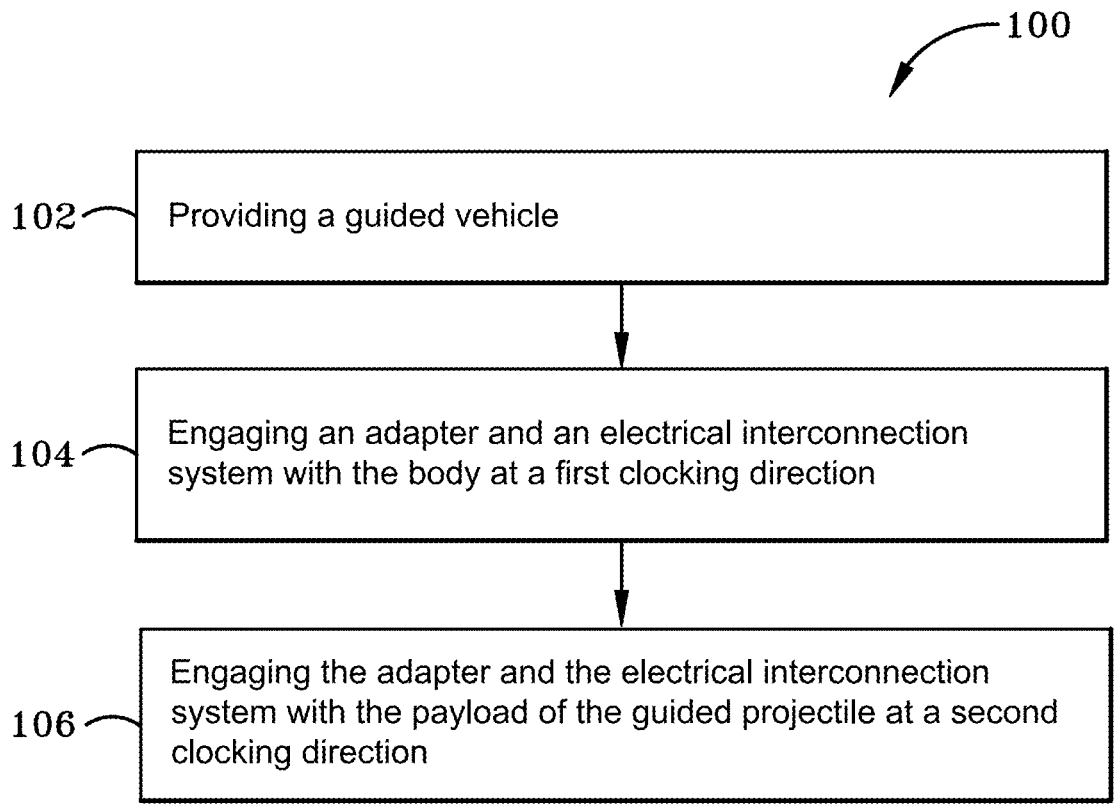
FIG. 9 (FIG. 9) is an exemplary method flowchart.

FIG. 9 illustrates a method 100. An initial step 102 of method 100 includes providing a guided vehicle, wherein the guide vehicle comprises at least: a body having a first end, a second end opposite to the first end, a longitudinal axis defined between the first end and the second end, and a payload disposed inside of the body between the first end and the second end; and a guidance kit configured to guide the guided vehicle. Another step 104 of method 100 includes engaging an adapter and an electrical interconnection system with the body at a first clocking direction. Another step 106 of method 100 includes engaging the adapter and the electrical interconnection system with the payload of the guided projectile at a second clocking direction; wherein the first clocking direction of the body and the second clocking direction of the payload are angularly aligned with one another or angularly misaligned with one another.

In other exemplary embodiments, optional and/or additional steps may be included in method 100. In one exemplary embodiment, method 100 may further include steps of: housing a portion of the payload and a portion of the guidance kit inside of and mechanically engaged with the adapter; and connecting the payload and the guidance kit with one another by the electrical interconnection system inside of the adapter. In another exemplary embodiment, method 100 may further include that the step of connecting the guidance kit and the payload with one another further comprises: connecting a slip ring contact of the electrical interconnection system with an electrical connection of the guidance kit; and connecting a power and signal board of the electrical interconnection system with the slip ring contact and an input port of the payload. In another exemplary embodiment, method 100 may further include that the step of connecting the slip ring contact of the electrical interconnection system with the electrical connection of the guidance kit further comprises: connecting a set of first input contacts provided at a first connection end of the slip ring contact with the electrical connection of the guidance kit; and connecting a set of first output contacts provided at a second connection end of the slip ring contact with the set of first input contacts; wherein the set of first output contacts is arranged in a concentric circle arrangement. In another exemplary embodiment, method 100 may further include that the step of connecting the guidance kit and the payload with one another further comprises: connecting a set of second input contacts provided on a first connection end of the power and signal board with the set of first output contacts of the slip ring contact; and connecting a second output contact provided on a second connection end of the power and signal board with an electrical power port of the payload. In another exemplary embodiment, method 100 may further include steps of: engaging a biaser of the electrical interconnection system with the adapter, the slip ring contact, and the power and signal board; and applying a biasing force against the slip ring contact and the power and signal board, by the biaser, to maintain the slip ring contact and the power and signal board inside of the adapter and engaged with the guidance kit and the payload. In another exemplary embodiment, method 100 may further include steps of engaging a spacer of the electrical interconnection system with the power and signal board and the payload; and spacing the power and signal board and the payload apart from one another, via the spacer, inside of the adapter.

In another exemplary embodiment, another method, similar to method 100, may be performed. An initial step of the exemplary method includes providing an adapter and an electrical interconnection system with a guided vehicle. Another step of exemplary method includes effecting a body of a guidance kit of the guided vehicle to be mechanically connected with an adapter at a first clocking direction. Another step of exemplary method includes effecting a payload of the guided projectile to be mechanically connected with the adapter at a second clocking direction. Another step of exemplary method includes effecting the guidance kit and the payload to be electrically connected with one another by the electrical interconnection system. Another step of exemplary method includes effecting the guidance kit to output at least one signal to the payload via the electrical interconnection system. Another step of exemplary method also includes that the first clocking direction of the guidance kit and the second clocking direction of the payload are angularly aligned with one another or angularly misaligned with one another.

In other exemplary embodiments, optional and/or additional steps may be included in exemplary method. In one exemplary embodiment, exemplary method may further include that the step of effecting the guidance kit and the payload to be electrically connected with one another further comprises: effecting a portion of the payload and a portion of the guidance kit to be housed inside of and mechanically engaged with the adapter; and effecting the electrical interconnection system to electrically connect the payload and the guidance kit with one another inside of the adapter. In another exemplary embodiment, exemplary method may further include that the step of effecting the guidance kit and the payload to be electrically connected with one another further comprises: effecting a slip ring contact of the electrical interconnection system to electrically connect with an electrical connection of the guidance kit; and effecting a power and signal board of the electrical interconnection system to electrically connect with the slip ring contact and an input port of the payload. In another exemplary embodiment, exemplary method may further include that the step of effecting the slip ring contact of the electrical interconnection system to electrically connect with the electrical connection of the guidance kit further comprises: effecting a set of first input contacts provided at a first connection end of the slip ring contact to electrically connect with the electrical connection of the guidance kit; and effecting a set of first output contacts provided at a second connection end of the slip ring contact to electrically connect with the set of first input contacts; wherein the set of first output contacts is arranged in a concentric circle arrangement. In another exemplary embodiment, exemplary method may further include that that step of effecting the guidance kit and the payload to be electrically connected with one another further comprises: effecting a set of second input contacts provided on a first connection end of the power and signal board to electrically connect with the set of first output contacts of the slip ring contact; and effecting a second output contact provided on a second connection end of the power and signal board to electrically connect with an electrical power port of the payload. In another exemplary embodiment, exemplary method may further include steps of effecting a biaser of the electrical interconnection system to mechanically engage with the adapter, the slip ring contact, and the power and signal board; and effecting the biaser to apply a biasing force against the slip ring contact and the power and signal board to maintain the slip ring contact and the power and signal board inside of the adapter and engaged with the guidance kit and the payload. In another exemplary embodiment, exemplary method may further include steps of effecting a spacer of the electrical interconnection system to mechanically engage with the power and signal board and the payload; effecting the power and signal board and the payload to be spaced apart from one another, via the spacer, inside of the adapter.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of components A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A guided vehicle, comprising:

a body having a first end, a second end opposite to the first end, a longitudinal axis defined between the first end and the second end, and a payload disposed inside of the body between the first end and the second end;

a guidance kit configured to guide the guided vehicle; and an adapter mechanically connecting the payload and the guidance kit with one another; and an electrical interconnection system electrically connecting the guidance kit and the payload with one another inside of the adapter.

2. The guided vehicle of claim 1, wherein when the payload and the guidance kit are mechanically connected with one another and electrically connected with one another, the payload and the guidance kit are angularly aligned at a same clock position measured relative to the longitudinal axis or angularly displaced at different clock positions measured relative to the longitudinal axis.

3. The guided vehicle of claim 1, wherein the electrical interconnection system comprises at least:

a slip ring contact electrically connected with an electrical connection of the guidance kit; and a power and signal board electrically connected with the slip ring contact and an input port of the payload.

4. The guided vehicle of claim 3, wherein the slip ring contact comprises:

a base wall having a first connection end facing the guidance kit and a second connection end opposite to the first connection end and facing the payload; and a set of first input contacts provided on the first connection end and electrically connecting with the electrical connection of the guidance kit.

5. The guided vehicle of claim 4, wherein the slip ring contact further comprises:

a set of first output contacts provided on the second connection end and electrically connected with the set of first input contacts through the base wall;

wherein the set of first output contacts is arranged in a concentric circle arrangement.

6. The guided vehicle of claim 4, wherein the slip ring contact further comprises:

an extension extending outwardly from the base wall at the first connection end;

wherein the extension is configured to operably engage with the guidance kit inside of the adapter.

7. The guided vehicle of claim 5, wherein the power and signal board comprises:

a base wall having a first connection end facing the slip ring contact and a second connection end opposite to the first connection end and facing the payload;

a set of second input contacts provided at the first connection end and electrically connecting with the set of first output contacts; and a second output contact provided at the second connection end and electrically connecting with the input port of the payload.

8. The guided vehicle of claim 3, wherein the adapter comprises:

a first end;

a second end longitudinally opposite to the first end; and a passageway defined between the first end and the second end and being accessible at the first end and the second end;

wherein a portion of the payload and the guidance kit is housed inside of and mechanically engaged with the adapter inside of the passageway; and wherein the electrical interconnection system electrically connects with the payload and the guidance kit inside of the passageway.

9. The guided vehicle of claim 8, wherein the adapter further comprises:

an interior surface extending between the first end and the second end and disposed inside of the passageway; and an internal projection extending radially into the passageway from the interior surface.

10. The guided vehicle of claim 9, further comprising:

a biaser mechanically engaged with the internal projection of the adapter, the slip ring contact, and the power and signal board; and a spacer mechanically engaged with the power and signal board and the payload;

wherein a combination of the biaser and the spacer maintains the position of the slip ring contact and the power and signal board inside of the adapter by biasing means.

11. The guided vehicle of claim 10, wherein the biaser comprises:

a first engagement end mechanically engaged with the internal projection;

a second engagement end opposite to the first engagement end and mechanically engaged with the power and signal board; and an opening defined in the biaser between the first engagement end and the second engagement end;

wherein the slip ring contact and the power and signal board electrically connect with one another through the opening.

12. The guided vehicle of claim 10, wherein the spacer comprises:

a first engagement end mechanically engaged with the power and signal board;

a second engagement end opposite to the first engagement end and mechanically engaged with the payload; and an opening defined in the spacer between the first engagement end and the second engagement end;

wherein the power and signal board and the payload electrically connect with one another through the opening.

13. The guided vehicle of claim 8, wherein the adapter further comprises:

a first threading defined inside of the passageway proximate to the first end for threadably engaging with threads of a body of the guidance kit; and a second threading defined inside of the passageway proximate to the second end for threadably engaging with threads of the payload.

14. A method comprising steps of:

providing a guided vehicle, the guide vehicle comprises at least:

a body having a first end, a second end opposite to the first end, a longitudinal axis defined between the first end and the second end, and a payload disposed inside of the body between the first end and the second end; and a guidance kit configured to guide the guided vehicle;

engaging an adapter and an electrical interconnection system with the body at a first clocking direction; and engaging the adapter and the electrical interconnection system with the payload of the guided projectile at a second clocking direction;

wherein the first clocking direction of the body and the second clocking direction of the payload are angularly aligned with one another or angularly misaligned with one another.

15. The method of claim 14, further comprising:

housing a portion of the payload and a portion of the guidance kit inside of and mechanically engaged with the adapter; and connecting the payload and the guidance kit with one another by the electrical interconnection system inside of the adapter.

16. The method of claim 15, wherein the step of connecting the guidance kit and the payload with one another further comprises:

connecting a slip ring contact of the electrical interconnection system with an electrical connection of the guidance kit; and connecting a power and signal board of the electrical interconnection system with the slip ring contact and an input port of the payload.

17. The method of claim 16, wherein the step of connecting the slip ring contact of the electrical interconnection system with the electrical connection of the guidance kit further comprises:

connecting a set of first input contacts provided at a first connection end of the slip ring contact with the electrical connection of the guidance kit; and connecting a set of first output contacts provided at a second connection end of the slip ring contact with the set of first input contacts;

wherein the set of first output contacts is arranged in a concentric circle arrangement.

18. The method of claim 17, wherein the step of connecting the guidance kit and the payload with one another further comprises:

connecting a set of second input contacts provided on a first connection end of the power and signal board with the set of first output contacts of the slip ring contact; and connecting a second output contact provided on a second connection end of the power and signal board with an electrical power port of the payload.

19. The method of claim 16, further comprising:

engaging a biaser of the electrical interconnection system with the adapter, the slip ring contact, and the power and signal board; and applying a biasing force against the slip ring contact and the power and signal board, by the biaser, to maintain the slip ring contact and the power and signal board inside of the adapter and engaged with the guidance kit and the payload.

20. The method of claim 19, further comprising:

engaging a spacer of the electrical interconnection system with the power and signal board and the payload; and spacing the power and signal board and the payload apart from one another, via the spacer, inside of the adapter.

* * * * *